United States Patent [19]

Shinneman

[11] 4,386,549

[45] Jun. 7, 1983

[54] SPECIAL EFFECTS MALLET

[76] Inventor: Leonice L. Shinneman, 1234 Skeel Dr., Camarillo, Calif. 93011

[21] Appl. No.: 308,357

[22] Filed: Oct. 5, 1981

[51] Int. Cl.[3] ..... G10D 13/00

[52] U.S. Cl. ..... 84/422 S

[58] Field of Search ..... 84/422 S, 414

[56] References Cited

U.S. PATENT DOCUMENTS

| | | | |
|---|---|---|---|
| 72,824 | 12/1867 | Durand | 84/422 S |
| 1,168,843 | 1/1916 | Baker | 84/422 S |
| 1,892,416 | 12/1932 | Vitto | 84/422 S |
| 2,040,603 | 5/1936 | Gladstone | 84/422 S |
| 2,586,163 | 2/1952 | Heiderich et al. | 84/422 S |
| 3,165,964 | 1/1965 | Stys et al. | 84/422 S |
| 3,425,309 | 2/1969 | Elzas et al. | 84/414 |
| 4,271,745 | 6/1981 | Shatto | 84/422 S |
| 4,300,438 | 11/1981 | Handal | 84/422 S |
| 4,307,647 | 12/1981 | Christian | 84/422 S |

*Primary Examiner*—Lawrence R. Franklin

*Attorney, Agent, or Firm*—Michael L. Harrison

[57] ABSTRACT

A special effects mallet for production of a variety of unique sound effects when used with percussion instruments. An ellipsoidally shaped mallet head of semi-rigid material having a high coefficient of friction when in contact with a percussion instrument such a drum head or the like, produces sounds imitative of an extremely uniform drum roll when drawn across the drumhead or the like. The frequency of the roll may be varied by varying the speed of movement or the angle of orientation of the mallet head.

7 Claims, 4 Drawing Figures

SPECIAL EFFECTS MALLET

BACKGROUND OF THE INVENTION

1. Field of the Invention

The present invention relates to the field of percussion musical instruments and in particular to percussion stick implements for producing special effects with percussion instruments.

2. Prior Art

Percussion instruments such as snare drums, conga drums and the like have traditionally been played by the use of two sticks, one held in each hand, with the weight and material of the stick being selected for the particular sound desired. Due to an increasing demand for novelty in recorded sound, musicians in general have been required to produce ever more unique sound effects. This has been particularly true of percussion players who have traditionally been called upon to supply an array of special effects for both live and recorded sound.

While a great deal of the uniqueness of a particular performer resides in his or her individual technique, nonetheless, special musical effects are still required and are achieved in some degree by an ever-increasing proliferation of special effects devices. Moreover, in the context of a highly competitive music industry, the production of special effects is increasingly the responsibility of fewer and fewer individuals. Thus, a single drummer may be required to provide the same array of special effects as could have been provided in the past by two or more players. A result has been increasing reliance upon these mechanical devices to provide the effects which would otherwise have been provided by individuals.

SUMMARY OF THE INVENTION

Accordingly, it is an object of the present invention to provide a mallet device for producing special effects with percussion instruments.

It is another object of the present invention to provide a mallet device which can produce a sustained drum roll effect when operated with one hand.

Briefly, the present invention accomplishes these and other objects through the provision of a resilient, semi-rigid mallet head secured to a handle of convenient length for positioning the mallet head on the general area of the drum head or other percussion instrument. The mallet head, in contact with the drum head, or the like, has a high coefficient of friction with the drum head as a consequence of which a mallet head, when drawn across the drum head rapidly in alternation, grips the drum head and releases it producing a rapid impulse sound against the drum head. A similar action on suspended cymbals, or the bars of marimbas and the like, also produces the similar sound.

DESCRIPTION OF THE PREFERRED EMBODIMENT

Figure 1:
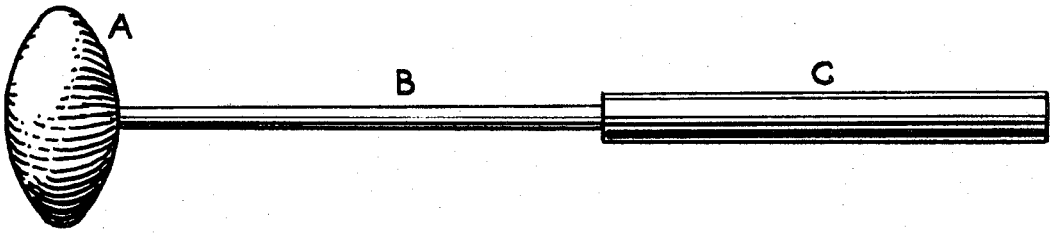
FIG. 1 is a side view of a special effects mallet in accordance with the present invention.
Figure 2:
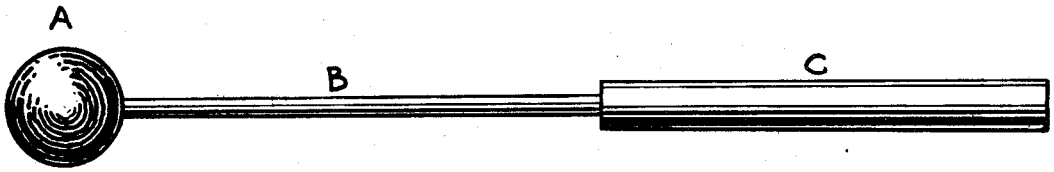
FIG. 2 is a top view of a special effects mallet in accordance with the present invention.
Figure 3:
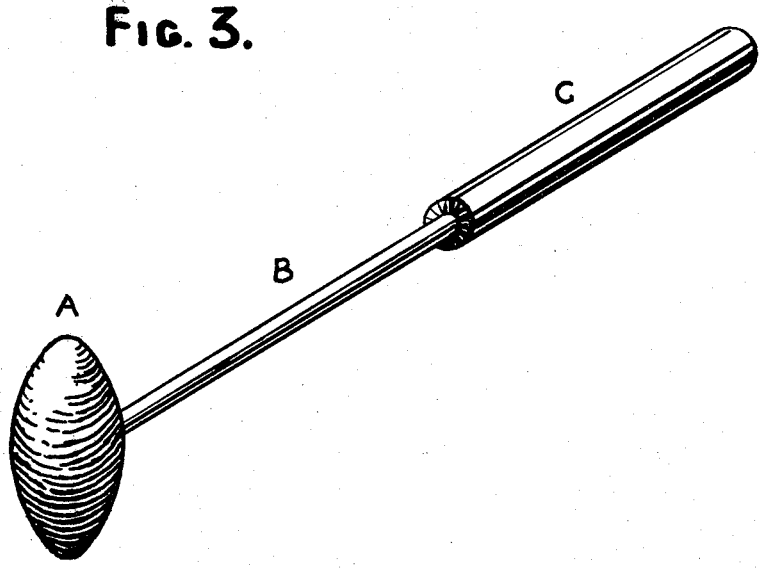
FIG. 3 is a perspective view of a special effects mallet in accordance with the present invention.

Referring first to FIG. 1 there is shown a mallet device for producing unique sound effects on percussion instruments in accordance with the present invention. Mallet head A is attached to a shaft B of convenient length, about which is located a handle, C, of a size suitable for comfortable and secure gripping by the player.

Mallet head A may be fabricated in any suitable shape, but for most predictable and reproducable results, it is preferably made in the form of a simple ellipsoid of approximately one and one-half inches overall length and approximately three quarters inch maximum diameter. The smooth contour of the ellipsoid, which is presented to the drum head regardless of the orientation of the ellipsoid with respect to the drum head, assures that the alignment of the mallet head is non-critical.

An ellipsoidal shape is preferrable over a spherical cylindrical shape, for example, for several reasons. A spherical shape presents the same engagement with and resistance to movement between the mallet and the drum head regardless of its orientation. The cylindrical shape, and indeed any other shape having a sharply changing surface such as rectangular prisms, triangular prisms, or the like requires an extremely exact orientation with respect to the drum head due to the rapid change in mechanical properties of mallet as the portion in contact with the drum head varies slightly. The spherical shape suffers from none of those drawbacks and is acceptable from the standpoint of reproducibility and predictability, but allows for no variation in the effects which can be accomplished with a single mallet head.

For the type of instrument described, and for use in general with snare drums or like instruments, a mallet head composed of relatively soft vinyl or equivalent is preferred. A hardness of approximately 40 Durometer hardness is preferred, although a wide range of hardnesses in the general vicinity of 40 Durometer hardness will produce satisfactory results.

Figure 4:
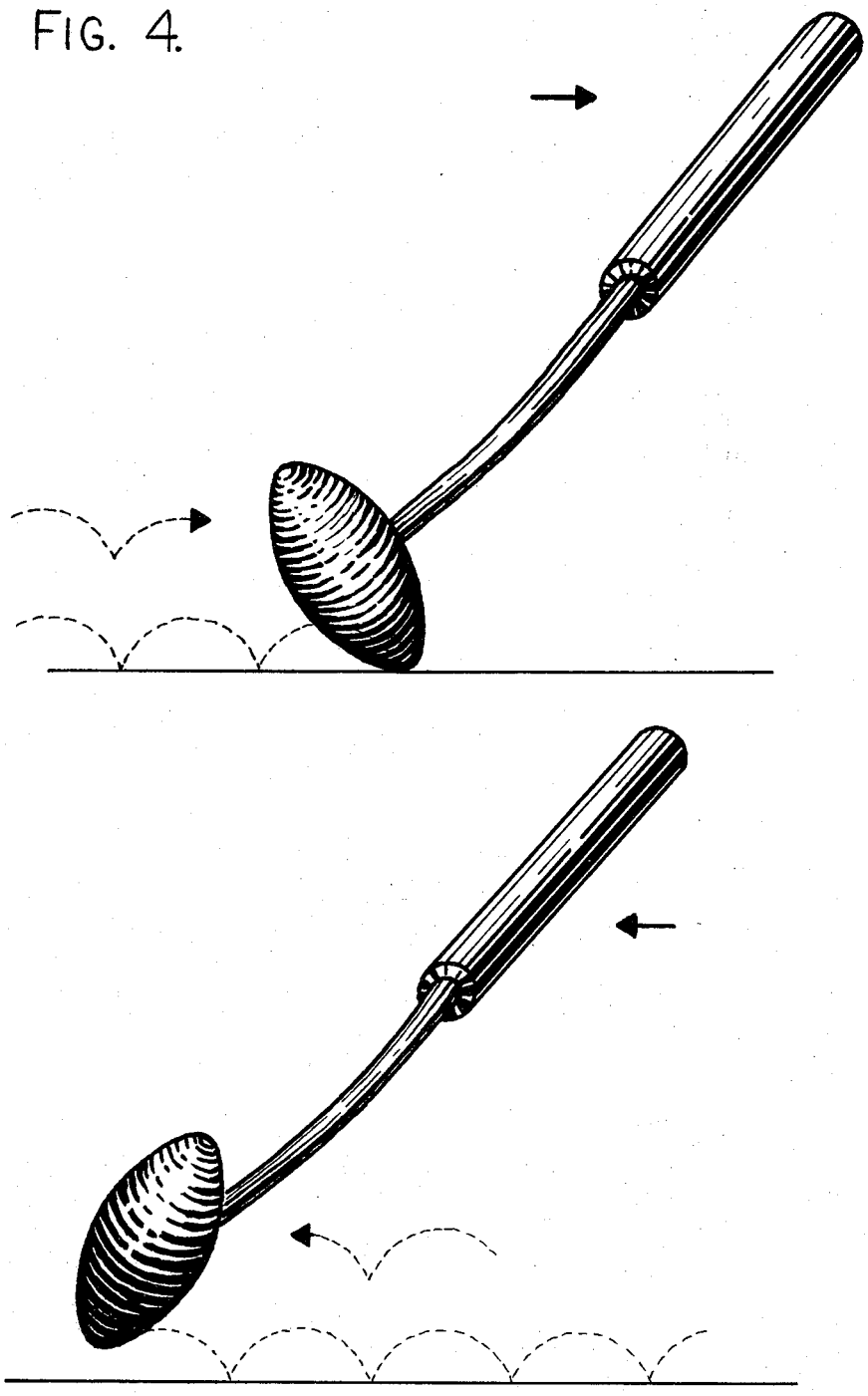
FIG. 4 is a diagram which illustrates the motion of the mallet head when in use.

In use, the mallet head A is placed in contact with the playing surface of a drum head and is moved laterally across the drum head while maintaining contact with it at all times. Generally, the mallet head will be oriented so that the tip preceeds the rest of the mallet head as it moves with respect to the drum head as shown in FIG. 4. Because the vinyl mallet head has a high coefficient of friction with respect to the drum head, its tip becomes momentarily fixed in position as it is brought into contact with the head. Then, as movement is imparted to the mallet head from the handle, stress builds up within the elastic body of the mallet head between the handle fixation point and the tip of the head until a point is reached at which the force, due to the built up stress, exceeds the friction force holding the mallet head in place. At that point, the surface in contact with the drum head releases and moves rapidly to another stable position at which point it again becomes attached, momentarily, to the drum head. As movement is continually imparted to the mallet head through the handle, the process repeats continuously. Thus, rapidly in succession, frictional forces attach then release between the mallet head and the drum head. At each release, and at each reattachment, a sharp movement of the drum head takes place. The resulting sound effect is as if though the drum head were being rapidly and repeatedly struck by conventional drumsticks. However, due to the elastic characteristics of the mallet head, which elasticity controls the time between successive percussive sounds, the resulting apparent drum roll is more uniform than any which can be produced by even the most skilled drummers. If the mallet head is kept at a fixed angular position with respect to the drum head, only the speed of movement of the mallet head with respect to the drum head will cause a variation in the intervals between successive sounds.

By controlling the speed of movement of the mallet with respect to the drum head, it is possible to achieve either a rapid or a slow drum roll. Moreover, by adjusting the angle of the major axis of the ellipsoid with respect to the drum head, it is possible to further vary the time interval between successive sounds. Thus, when the major axis of the mallet is perpendicular to the drum head, the longer and more flexible mass from the center of the mallet to the tip produces a lower frequency of vibration. By rotating the mallet to its side so that a very stiff portion of the mallet head is presented to the drum head, it is possible to cause a very high frequency of vibration to occur. In general, however, the mallet will be used with the ellipsoid's major axis being inclined at an angle of approximately thirty degrees from the vertical. In this inclination, it is possible to move the mallet from side to side, rotating the head at each time so that the tip of the mallet head preceeds the body as indicated in FIG. 4. When moved in the directions indicated in FIG. 4, the arc described by the dotted lines is followed by the tip of the mallet head. For clarity, the dimensions of the locus of points defining the path of the mallet head are exaggerated.

Handle B is preferably composed of flexible material which allows a uniform pressure to be applied to the mallet head. Differing stiffnesses of handles may be employed for achievement of differing sound effects.

Various other types of materials and handle shapes for producing the mallet may be employed as will be apparent to those skilled in the art. It will be further appreciated that other variations of the principle taught herein may be practiced still within the scope of the present invention which is defined only by the claims which follow.

What is claimed is:

1. A device for producing unique sound effects with percussion instruments, comprising:

a handle and;

a mallet head of semi-rigid material affixed to the handle, said mallet head having a surface which has a high coefficient of friction when in contact with a drum head or the like and having sufficient resilience so that when moved across a drum head or the like the mallet head rapidly in succession engages and is distorted then releases engagement with the drum head and rapidly regains its original shape thereby producing the effect of a sustained, highly uniform roll.

2. The device of claim 1 wherein the mallet head is composed of vinyl.

3. The device of claim 1 wherein the mallet head has a Durometer hardness in the range of 30 to 50.

4. The device of claim 1 wherein the mallet head is ellipsoidally shaped and the major axis of the ellipsoid is the axis of rotation of the ellipse, and wherein the handle is affixed to the ellipsoid in the vicinity of one of the minor axes.

5. The device of claim 4 wherein the ratio of the length of the major axis to the length of the minor axis of the ellipsoid ranges between three to one, and one and one-fourth to one.

6. The device of claim 5 wherein the mallet head is composed of a material having a durometer hardness ranging between 30 and 50.

7. The device of claim 4 wherein the mallet head is composed of a material having a Durometer hardness ranging between 30 and 50.

* * * * *